US005790928A

United States Patent [19]

Kovacs et al.

[11] Patent Number: 5,790,928

[45] Date of Patent: Aug. 4, 1998

[54] SWITCHABLE DUAL WAVELENGTH FLOOD LAMP FOR SIMPLIFIED COLOR PRINTING ARCHITECTURE BASED ON XEROCOLOGRAPHY

[75] Inventors: Gregory J. Kovacs, Mississauga, Canada; Delmer G. Parker, Rochester, N.Y.

[73] Assignee: Xerox Corporation, Stamford, Conn.

[21] Appl. No.: 786,590

[22] Filed: Jan. 21, 1997

[51] Int. Cl.[6] ..... G03G 21/00

[52] U.S. Cl. ..... 399/221; 347/118

[58] Field of Search ..... 399/221, 220, 399/177; 347/118, 139

[56] References Cited

U.S. PATENT DOCUMENTS

| | | | |
|---|---|---|---|
| 4,868,611 | 9/1989 | Symain | 355/328 |
| 5,208,632 | 5/1993 | Hurwitch et al. | 355/208 |
| 5,347,303 | 9/1994 | Kovacs et al. | 346/157 |
| 5,373,313 | 12/1994 | Kovacs | 346/157 |
| 5,444,463 | 8/1995 | Kovacs et al. | 347/118 |
| 5,592,281 | 1/1997 | Parker et al. | 399/156 |

*Primary Examiner*—R. L. Moses

[57] ABSTRACT

Full color, two-pass imaging process using black, magenta, cyan and yellow toners and Non-Interactive Development (NID) without fringe field development. A switchable wavelength flood lamp structure is provided for producing blue and red light. One wavelength is used during the first pass of a photoreceptor through various processing stations for revealing an imagewise voltage for development with magenta toner using an NID system. The other wavelength is used during a second pass of the photoreceptor for revealing another imagewise voltage to be developed with magenta toner.

16 Claims, 8 Drawing Sheets

SWITCHABLE DUAL WAVELENGTH FLOOD LAMP FOR SIMPLIFIED COLOR PRINTING ARCHITECTURE BASED ON XEROCOLOGRAPHY

BACKGROUND OF THE INVENTION

This invention relates to a full color, xerographic printing system using a Raster Output Scanning (ROS) system incorporating a dual wavelength laser diode source for the ROS and charge retentive surface response to the two wavelengths and, more particularly, to a full color, two-pass imaging process using black, magenta, cyan and yellow toners and Non-Interactive Development without fringe field development.

Xerocolography (dry color printing) is a color printing architecture which combines multi-level xerographic development with multiwavelength laser diode light sources, with a multiwavelength single polygon, single optics ROS and with a multiwavelength, multilayered photoreceptor to provide color printing in either a single or two pass. Inherently perfect registration is achieved since the various color images are all written at the same imaging station with the same ROS.

Present implementation of xerocolography uses a dual wavelength system. Semiconductor laser material systems are currently available for making the required light sources with IR and red light emissions, and high performance devices have been fabricated. Photoreceptor material systems are currently available for making the required IR+ red sensitive devices and high performance systems have been demonstrated with the mainline photoreceptor materials for ongoing developments, viz. BZP (benzimidazole perylene) and GaOHPc (hydroxygallium phthalocyanine).

Xerocolography is capable of producing either highlight color or process color images in a single pass as well as process color images in multiple passes. In creating full process color images, using Image On Image (IOI) imaging, toner particles are deposited on already developed toner images. In this imaging mode it is desirable to use Non-Interactive Development (NID) in order to avoid scavenging of an already developed image.

In order to use Non-interactive Development (NID) systems for creating IOI images, it is necessary to eliminate developed image fringe fields and/or preclude the formation of images having fringe fields which can not be eliminated. In the past, the problem of fringe field development has been obviated using voltage leveling corona devices such as a scorotron after one image development and prior to a subsequent image development on an already developed image in order to effect complete voltage neutralization of previously developed images thereby eliminating the fringe fields.

Following is a discussion of prior art, incorporated herein by reference, which may bear on the patentability of the present invention. In addition to possibly having some relevance to the question of patentability, these references, together with the detailed description to follow, are intended to provide a better understanding and appreciation of the present invention.

U.S. Pat. No. 4,868,611 entitled "Tri-Level Xerography Scorotron Neutralization Concept" granted to Richard P. Germain on Sep. 19, 1989 discloses the use of a scorotron after the development of a first image. The scorotron serves to bring that first image to complete charge neutralization which removes the voltage responsible for the fringe fields thereby precluding fringe field development during the development of a subsequent image.

U.S. Pat. No. 5,347,303 entitled "Full Color Xerographic Printing System With Dual Wavelength, Single Optical System ROS And Dual Layer Photoreceptor" granted on Sep. 13, 1994 to Kovacs et al discloses a full color xerographic printing system, either two pass or single pass, with a single polygon, single optical system Raster Output Scanning (ROS) system has a dual wavelength laser diode source for the ROS which images the dual beams at a single station as closely spaced spots or at two stations as closely spaced spots on a dual layer photoreceptor with each photoreceptor layer sensitive to or accessible by only one of the two wavelengths.

U.S. Pat. No. 5,444,463 entitled "Color Xerographic Printing System With Dual Wavelength, Single Optical System ROS And Dual Layer Photoreceptor" granted on Aug. 22, 1995 to Kovacs et al discloses a single pass color xerographic printing system. This printing system with a single polygon, single optical system Raster Output Scanning (ROS) system has a dual wavelength laser diode source for the ROS which images the dual beams at a single station as closely spaced spots on a dual layer photoreceptor.

U.S. Pat. 5,592,281 entitled "Development Scheme For Three Color Highlight Color Tri-level Xerography" discloses a method and apparatus wherein the creation of multiple color images is accomplished in a single pass utilizing a multilayered photoreceptor structure having layers which are responsive to different wavelength lasers. A composite image including three images areas is formed with substantially perfect registration. A CAD and DAD image are developed using CMB development and a second DAD image is developed using an NID development system. Development of the second DAD image without developing halos around the CAD image is effected by recharging the photoreceptor prior to development of the second DAD image.

BRIEF DESCRIPTION OF THE INVENTION

In accordance with the present invention, a full color, two-pass imaging process using black, magenta, cyan and yellow toners and Non-interactive Development without fringe field development is provided. To this end corona discharge is utilized in the manner described in the references noted above. That is, corona discharge is utilized to fully voltage level some of the already developed images prior to the development of subsequent images.

In addition to the use of corona discharge for effecting voltage leveling, the Raster Output Scanner (ROS) used for creating the latent electrostatic images is also used for voltage leveling of an image developed on the first pass. In particular, the voltage in photoreceptor areas corresponding to black toner images which have been recharged prior to the second pass are leveled using the 830nm wavelength of the ROS of a dual wavelength ROS.

Fringe field development is further precluded by forming, in a second pass of a two pass imaging process, only images which do not have fringe fields that could be developed. As will be appreciated, in a two pass, full color imaging system using black, magenta, cyan and yellow toners it is possible to form images in different ways some of which would present fringe fields at subsequent development stations and others which would not. In accordance with the present invention, those images which would result in fringe fields are not formed. They are precluded using the ROS to discharge those image areas to the background or other suitable voltage level prior to the second pass.

In addition to eliminating images that present fringe fields, it is also desirable to preclude development of IOI using the same color toners. This is accomplished by not forming those images which would lead to development of one color toner on top of the same color toner. The reason for the forgoing is that there are other ways of forming images of that color and that the resultant gloss of images developed with a double thickness of the same color toner would be different than the rest of the images.

DETAILED DESCRIPTION OF THE PREFERRED EMBODIMENT OF THE INVENTION

Figure 1:
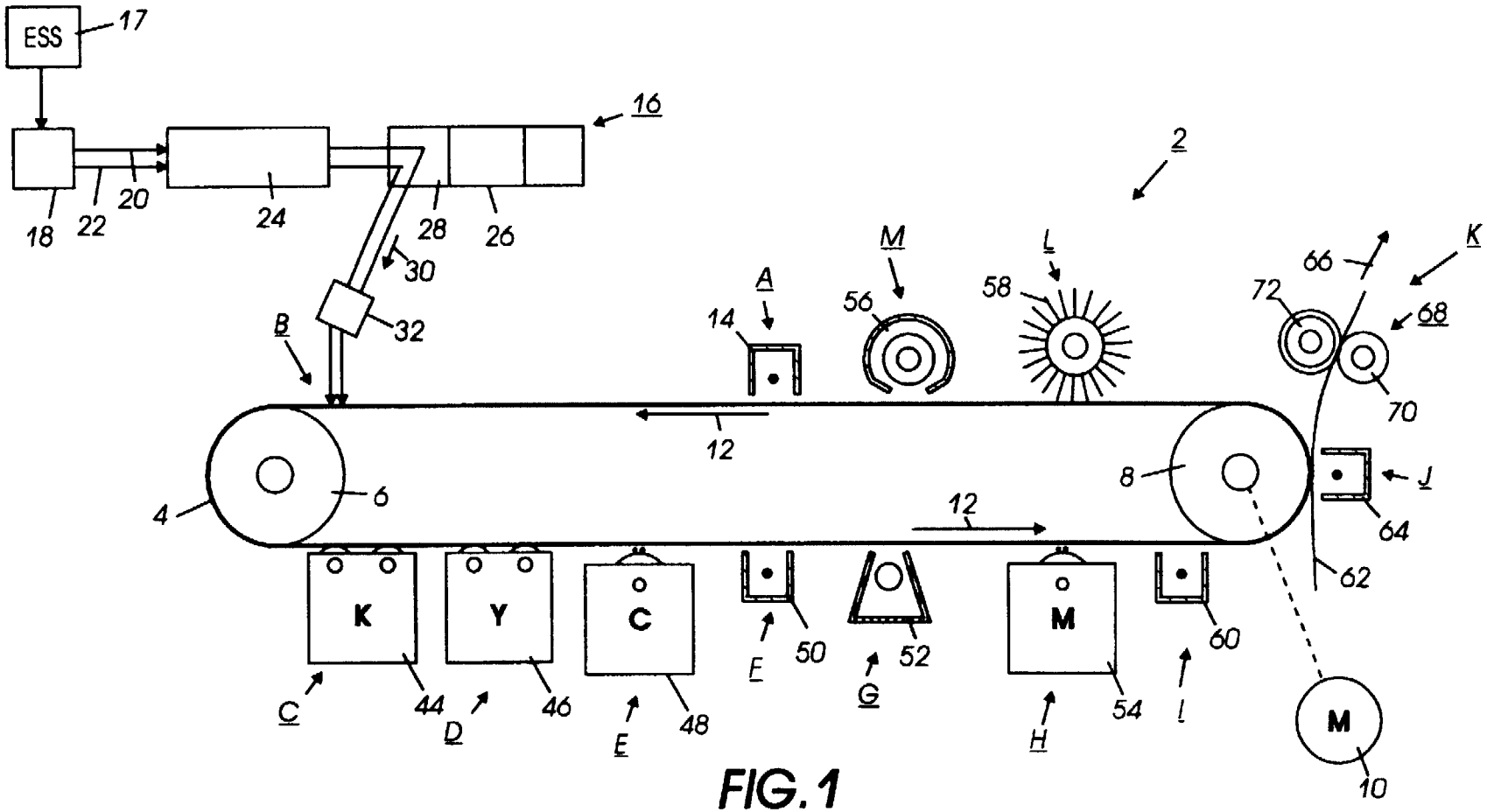
FIG. 1 is a schematic illustration of a two pass xerographic printing system.

In FIG. 1 there is illustrated a two pass xerographic printing system 2 representing one embodiment of the invention. The printing system utilizes a charge retentive member in the form of a photoconductive belt 4 comprising two photoconductive layers and an electrically conductive substrate. The belt 4 is mounted for sequential movement past a charging station A, an exposure station B, a first development station C, a second development station D, a third development station E, a voltage leveling station F, a uniform exposure station G, a fourth development station H, a pre-transfer charging station 1, a transfer station J, a fusing station K, a cleaning station L and an erasure/exposure station M. The belt moves in the direction of arrow 12 to advance successive portions of the belt sequentially through the various processing stations positioned about the path of movement thereof for forming images in two passes of the belt through the aforementioned process stations, A through M.

The belt 4 is entrained about a plurality of rollers 6 and 8, the latter of which is used as a drive roller and the others of which can be used to provide suitable tensioning of the photoreceptor belt 4. A motor 10 rotates the drive roller 8 to advance the belt 4 in the direction of arrow 12. The drive roller is operatively coupled to the motor by suitable means such as a drive belt.

Initially successive portions of belt 4 pass through charging station A, where a corona discharge device such as a scorotron, corotron, or dicorotron, indicated generally by the reference numeral 14, charges the belt 4 to a selectively high uniform positive or negative potential, $V_O$ of approximately −800 volts. Any suitable control circuit, well known in the art, may be employed for controlling the corona discharge device 14.

Next, the charged portions of the photoreceptor surface are advanced through exposure station B. At exposure station B, the uniformly charged photoreceptor or charge retentive surface 4 is exposed to a dual wavelength ROS device 16 to form a tri-level image. A tri-level image is one containing fully charged areas, fully discharged areas and those areas which have been discharged to $V_o/2$. The fully charged areas are subsequently developed using Charged Area Development (CAD) with black toner according to the scheme in FIG. 4 while the discharged areas are developed using Discharged Area Development (DAD) with magenta toner according to the scheme in FIG. 4. The photoreceptor can be discharged to $V_o/2$ by individual exposure with either the red or infrared beam. Exposure with the red beam only will yield a white area according to the scheme in FIG. 4. Exposure with the infrared beam only will eventually yield a DAD cyan image after the flood exposure step effected in Station G of FIG. 1. An Electronic Subsystem (ESS) 17 converts previously stored image information into appropriate control signals for the ROS output in an imagewise fashion. Thus, in the absence of an image signal, the ROS has both laser beams off over a given area whereby a CAD image is formed representing one image color. For information corresponding to a second color image the ROS has both laser beams on over a given area for forming DAD images. For information corresponding to the white area the red laser beam only is on. For information corresponding to the second DAD color the IR laser beam only is on. The image data acquisition, data storage, and computation under the control of the ESS 17 are well within the capabilities of present and future microprocessor-based machine controllers and do not represent part of the invention.

The Raster output scanner 16 uses a dual wavelength hybrid laser semiconductor structure 18 consisting of a 670 nm wavelength laser emitter such as a semiconductor structure of AlGaInP and a 830 nm laser emitter such as a semiconductor structure of AlGaAs, both laser emitter structures being known to those of ordinary skill in the art. Light Emitting Diodes (LED) may also be employed.

The different wavelength beams may be tangentially offset and are scanned sequentially over top of each other on the photoreceptor on the same scan to maintain registration and avoid misalignment of the images. The beams may also be sagittally offset and still scanned on top of each other on different scans. The tangential offset of each laser emitter is generally given an upper limit of 300 μm since tangential offset does not introduce scan line bow up to that limit. The effect of tangential offset is to require delay in the electronic modulation signals to one of the dual beams relative to the other since one beam lags the other during scanning across the photoreceptor. One or more beams can be emitted at each wavelength. The raster output scanner could also use a dual wavelength monolithic semiconductor laser structure 18 where generally the offset between the two lasers will be purely sagittal. Light Emitting Diodes (LED) may also be employed.

The dual wavelength laser structure provides a substantially common spatial origin for each beam. Each beam is independently modulated so that it exposes its associated photoreceptor in accordance with a respective color image.

In the raster output scanner 16, the two laser beams 20 and 22 from the laser structure 18 are input to an achromatized (wavelength corrected) conventional beam input optical system 24 which collimates, conditions and focuses the beams onto an optical path such that they impinge on a rotating polygon mirror 26 having a plurality of facets 28. As the polygon mirror rotates, the facets cause the reflected beam to deflect repeatedly in the direction indicated by the arrow 30. The deflected laser beams are input to a single set of achromatized imaging and correction optics 32, which corrects for errors such as polygon angle error and wobble and focuses the beams onto the photoreceptor belt. The semiconductor laser beams are modulated by modulating the drive currents to each of the lasers.

As stated earlier, at exposure station B, the uniformly charged photoreceptor or charge retentive surface 4 is exposed to ROS 16 which causes the charge retentive surface to remain charged or to be discharged in accordance with the output from the scanning device.

Figure 2:
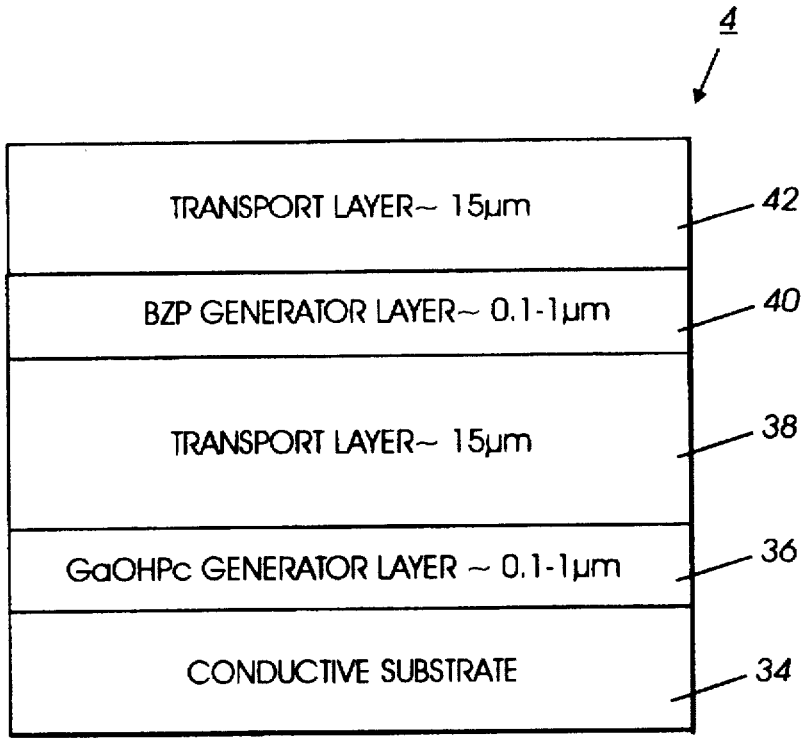
FIG. 2 is a schematic illustration of a dual layer photoreceptor belt for use in the two pass xerographic printing system of FIG. 1.

As illustrated in FIG. 2 the photoreceptor belt 4 consists of a flexible electrically conductive substrate 34. The substrate can be opaque, translucent, semi-transparent, or transparent, and can be of any suitable conductive material, including copper, brass, nickel, zinc, chromium, stainless steel, conductive plastics and rubbers, aluminum, semitransparent aluminum, steel, cadmium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. In addition, the substrate can comprise an insulative layer with a conductive coating, such as vacuum-deposited metallization on plastic, such as titanized or aluminized Mylar™ polyester, wherein the metalized surface is in contact with the bottom photoreceptor layer or any other layer such as a charge injection blocking or adhesive layer situated between the substrate and the bottom photoreceptor layer. The substrate has any effective thickness, typically from about 6 to about 250 microns, and preferably from about 50 to about 200 microns, although the thickness can be outside of this range. The photoreceptor belt comprises a pair of photoreceptor structures each including a charge generation layer and a charge transport layer.

Adhered to the substrate 34 is a GaOHPc first or lower generator layer 36 approximately 0.1 to 1 μm thick, a first or lower transport layer 38 of N,N'-diphenyl-N,N'-bis(3"-methylphenyl)-(1,1'-biphenyl)-4,4'-diamine (TPD) in polycarbonate which is hole transporting and approximately 15 μm thick, a benzimidazole perylene (BZP) second or upper generator layer 40 approximately 0.1 to 1 μm thick, a second or upper transport layer 42 of TPD in polycarbonate which is hole transporting and approximately 15 μm thick.

The GaOHPc generator layer is thin enough to maintain low dark decay and the BZP generator layer is thick enough to be opaque to the wavelength used to discharge it. BZP is known to be coatable to opaque thicknesses while maintaining low dark decay.

For this illustrative example, the GaOHPc generator layer is infrared sensitive at 830 nm and the BZP generator layer is red sensitive at 670 nm. The opacity of BZP at 670 nm insures that this wavelength does not also discharge the underlying GaOHPc. On the other hand the BZP layer is transparent to 830 nm. Therefore this wavelength passes right through the BZP and discharges only the GaOHPc layer below. Therefore, each generator layer can only be accessed by one of the two wavelengths.

The generator and transport layers can be deposited or vacuum evaporated or solvent coated upon the substrate by means known to those of ordinary skill in the art.

Figure 3:
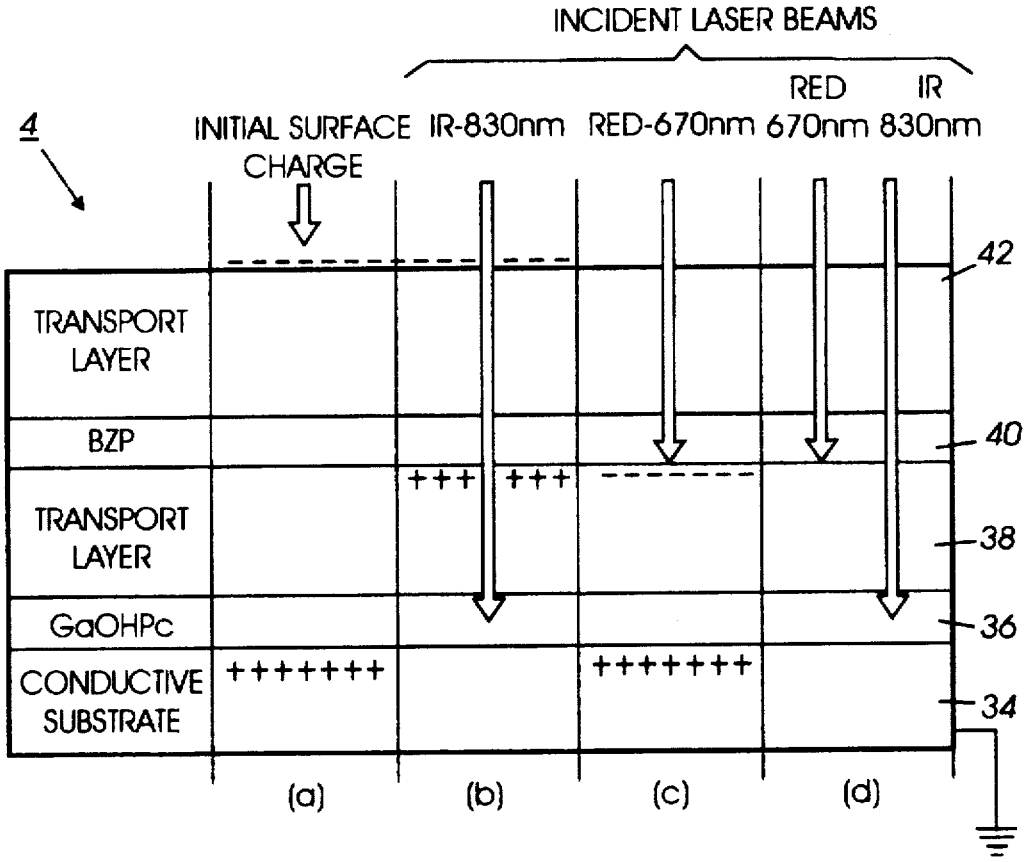
FIG. 3 is a schematic illustration of the state of the photoreceptor following initial exposure thereof .

During exposure of the photoreceptor belt 4 to the light beams from the ROS as shown in FIG. 3, the 670 nm wavelength of one modulated beam would be entirely absorbed in the opaque BZP generator layer. Exposure with the 670 nm beam would therefore discharge the BZP and upper transport layer 42. None of the 670 nm light beam would reach the GaOHPc layer so that it and the lower transport layer 36 would remain fully charged. The second wavelength is chosen to be 830 nm to insure that it will pass completely through the BZP layer without effecting any discharge of that layer or upper transport layer 42. However, the GaOHPc layer is sensitive to 830 nm and exposure with this wavelength from a modulated beam will discharge that layer and the lower transport layer 36. The 830 nm exposure should not be allowed to effect discharge through the benzimidazole perylene layer and the upper transport layer.

As illustrated in FIG. 3, exposure of an area of the photoreceptor belt 4 to the both wavelengths or to only one of the wavelengths results in the photoreceptor being electrostatically conditioned as follows: (a) the unexposed areas which retain the original surface voltage, (b) areas exposed with the 830 nm beam which are discharged to roughly one-half of the original surface voltage, (c) areas exposed with the 670 nm beam which are also discharged to roughly one-half of the original photoreceptor voltage, $V_0$ and (d) the areas exposed with both the 830 and 670 nm wavelength beams which are fully discharged. While only three voltage levels are present on the photoreceptor immediately following exposure, there will be four distinctly different areas after xerographic development during the first pass of the photoreceptor through the process stations. While the surface voltages in regions (b) and (c) are roughly equal after exposure they have been formed in very distinct ways. During the development process the photoreceptor will remember how these voltages were formed to allow development in very different ways in the two regions.

The image area represented by (a) corresponds to the CAD portion of a trilevel image while the image area represented by (d) corresponds to the DAD portion of a tri-level image. The areas represented by (b) and (c) in FIG. 3 are at a voltage level corresponding to the background level of the tri-level image. Because of the way these images were formed the area (b) represents a second DAD image area which initially is not distinguishable from the background voltage level at (c). At the appropriate point in the imaging process, the second DAD image is rendered distinguishable so that it can be developed.

Figure 4A:
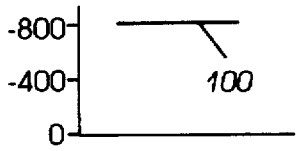
FIG. 4*a* is a plot of photoreceptor voltage versus location of a uniformly charged photoreceptor.

The process steps for printing all six primary colors of cyan (c), yellow (y), magenta (m), blue (b), green (g) and red (r), in addition to black (k) and white (w) during operation of the two-pass xerographic printing system of FIG. 1 will now be described. With the xerographic setup illustrated in FIG. 1, black, yellow and magenta images are formed in a first pass of the photoreceptor belt 4 through the process stations depicted therein. In practice, the photoreceptor is initially uniformly charged to a voltage level sufficiently high in order to allow for photoreceptor dark decay to $V_0$ equal to −800 in the elapsed time for the photoreceptor to move from the charging station A to the exposure station B. $V_0$ is represented by reference character 100 as shown in FIG. 4*a*.

Figure 4B:
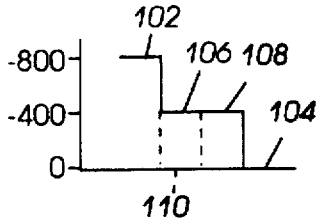
FIG. 4*b* is a plot of photoreceptor voltage versus location depicting the voltage profile of a tri-level image after an initial exposure step.
Figure 4C:
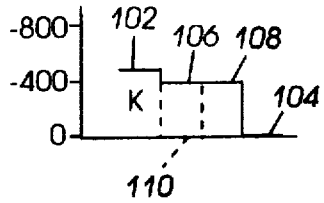
FIG. 4*c* is a plot of photoreceptor voltage versus location showing the state of the photoreceptor after development of the CAD image with black toner.
Figure 4D:
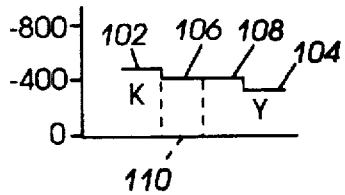
FIG. 4*d* is a plot of photoreceptor voltage versus location showing the state of the photoreceptor after development of the DAD image with yellow toner
Figure 4E:
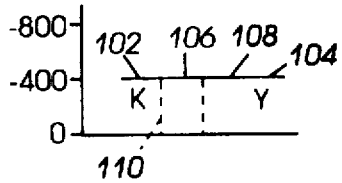
FIG. 4*e* is a plot of photoreceptor voltage versus location showing the state of the photoreceptor following a voltage leveling step.
Figure 4F:
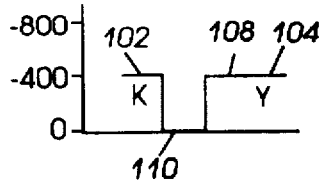
FIG. 4*f* is a plot of photoreceptor voltage versus location showing the state of the photoreceptor after flood exposure of the photoreceptor with blue light to form a second DAD image.

Exposure of the uniformly charged photoreceptor 4, at exposure station B during the first pass, results in the voltage profile shown FIG. 4*b*. As shown therein, the voltage profile initially comprises, unipolar, three voltage level images represented by the unexposed CAD image area 102, exposed DAD image area 104 created using both the 670 and 830 nm wavelength beams and the background areas 106 and 108 exposed, one at the 830 nm wavelength and one at 670 nm wavelength. An indistinguishable, second DAD image 110 is also formed at this point.

At the development station C (FIG. 1), the −800 volt unexposed or non-discharged (CAD) areas 102 are developed with Infrared (IR) transmissive black toner, k (FIG. 4c) using a Conductive Magnetic Brush (CMB) developer system 44. For this purpose, the developer system 44 is electrically biased at about −500 volts.

Next the photoreceptor is moved past a CMB developer housing 46 at development station D (FIG. 1). Here yellow toner, y is deposited onto the DAD image areas 104 (FIG. 4*d*) which are at the residual voltage level of the photoreceptor due to the exposure with both the 830 and 670 nm wavelength beams. The developer housing 46 is electrically biased at −300 volts.

The photoreceptor then moves past a developer housing 48 at development station E which is disengaged from its development zone since it contains cyan toner, c which is not used during the first pass of the two pass imaging process. The voltage levels in the developed CAD and DAD image areas are leveled to the background voltage using a suitable corona discharge device 50 at voltage leveling station F.

Figure 4G:
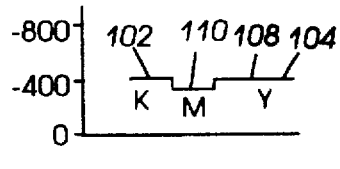
FIG. 4*g* is a plot of photoreceptor voltage versus location showing the state of the photoreceptor after development the second DAD image with magenta toner

The aforementioned indistinguishable or second DAD image 110 is now rendered distinguishable (FIG. 4*f*) such that it can be developed using magenta toner, m contained in a fourth development housing 54 at the development station H. This is accomplished using the blue light component of a combination red and blue food lamp structure 52. As the portions of the photoreceptor containing images 110 move past the developer housing structure 54, magenta toner, m is deposited thereon (FIG. 4*g*).

Movement of the photoreceptor past a pretransfer device 60 at the pretransfer station I is effected without pretransfer treatment since the pretransfer corotron is not activated during the first pass. Likewise, the photoreceptor moves past a transfer corona device 64 at transfer station J and a residual toner removal system 58 positioned at cleaning station L without image transfer and without photoreceptor cleaning being effected.

At the erase station M, the photoreceptor is subjected to white light illumination from a lamp 56 for erasing the photoreceptor. This is followed by recharging of the photoreceptor with the corona device 14 at the charging station A. The flood illumination and recharge steps serve to return the voltage level of the photoreceptor to the original −800 volts (FIG. 4*h*) pursuant to image creation during the second pass of the full color imaging process.

Figure 4H:
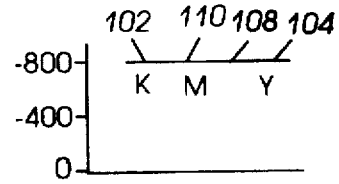
FIG. 4*h* is a plot of photoreceptor voltage versus location showing the state of the photoreceptor after blanket exposure with white light and recharging of the photoreceptor to approximately -800 volts.

Thus, after the development of black, magenta and yellow images on the photoreceptor 4 during the first imaging pass, and after the aforementioned erase and recharging steps, the photoreceptor contains black, yellow and magenta images, and also untoned white areas, all at −800 volts (FIG. 4*h*).

Exposure of the photoreceptor in this state to the dual wavelength ROS 16, without the application of novel aspects of the present invention, would result in four tri-level images being formed, for each of the developed image areas (i.e., black, magenta and yellow) and for the non-developed images areas of the photoreceptor. Thus, the photoreceptor would, without practicing the invention, contain black image areas, magenta image areas, yellow image areas and non-developed areas at the CAD voltage level of −800 volts, at the background level of −400 volts and at the DAD voltage level of 0 volts. This would preclude the use of NID for development of cyan and magenta images during the second pass of the imaging process because some components of the tri-level images would present fringe fields to the cyan and magenta developer housings which are used to develop DAD images during the second pass. For example, any image at the −800 volt level such as the black, yellow and magenta images would contain fringe fields which would undergo unwanted edge development. Also, since it is undesirable to add toner to certain of the image areas formed on the first pass such as the black image areas. Likewise, it is undesirable to deposit magenta on magenta images created in the first pass.

Accordingly, pursuant to the present invention during the second pass, tri-level images are not formed using the black toner images at −800 volts. Instead all of the −800 volt black image areas are reduced to the background voltage of -400 volts, reference character 120, using the ROS 16 so that they can neither be redeveloped nor present fringe fields to the DAD developer housings when passing there through (4*i*). Developer housings used during the first pass are disabled.

Figures 4I, 4J, 4K, 4L, 4M, 4N:
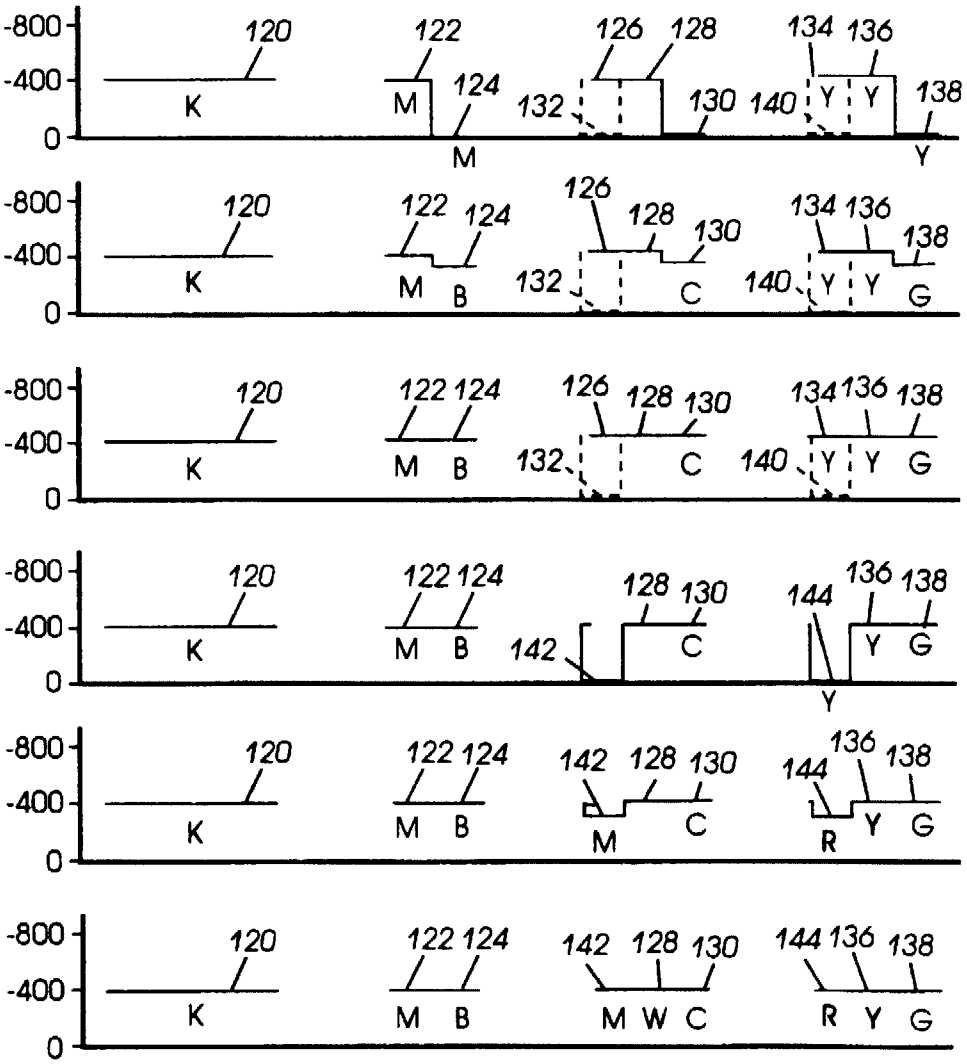
FIG. 4*i* is a plot of photoreceptor voltage versus location showing the state of the photoreceptor after a photoreceptor exposure pursuant the second pass of the photoreceptor through the xerographic processing stations.
FIG. 4*j* is a plot of photoreceptor voltage versus location showing the state of the photoreceptor after deposition of cyan toner in image configuration onto untoned areas and onto magenta and yellow images formed in the first pass.
FIG. 4*k* is a plot of photoreceptor voltage versus location showing the state of the photoreceptor after another recharge step.
FIG. 4*l* is a plot of photoreceptor voltage versus location showing the state of the photoreceptor after flood exposure of the photoreceptor with red light to form another DAD image.
FIG. 4*m* is a plot of photoreceptor voltage versus location showing the state of the photoreceptor after development of the DAD image of FIG. 41 with magenta toner.
FIG. 4*n* is a plot of photoreceptor voltage versus location showing the state of the photoreceptor after pretransfer charging of the photoreceptor and images contained thereon.

Instead of forming tri-level images in the magenta areas, those areas are reduced to either the background voltage level 122 using the 670 nm wavelength beam or to the residual or DAD image area, 124 equal to 0 volts using both the 830 nm and 670 nm wavelength beams (second voltage profile FIG. 4*i*).

The −800 volt undeveloped voltage areas on the photoreceptor in FIG. 4*h* are reduced to −400 volt level at 126 and 128 using the 830 nm and 670 nm wavelength beams and to DAD or 0 volt level 130 using both the 830 nm and 670 nm wavelength beams (FIG. 4*i*). Non-developable image 132 is also created at this time.

In the same manner, the −800 volt yellow image areas are used to form background areas 134 and 136 using the 830 nm and 670 nm wavelength beams and to the 0 volt level to form the DAD image, 138 using both the 830 nm and 670 nm wavelength beams. Non-developable image 140 is also created at this time.

During the second pass cyan (c) and magenta (m) toners are used to create blue (b), green (g), red (r) and magenta (m) images. Thus, cyan toner is deposited on yellow images created during the first pass resulting in green images. Magenta toner is deposited on yellow images created in the first pass resulting in red images and cyan toner is deposited on magenta images created during the first pass resulting in blue images.

During the second pass of the imaging process, the black and yellow developer housings 44 and 46 are disengaged. These developer housings can be disabled by retracting them from their respective developer zones or in any other suitable manner. As the magenta, DAD image 124 of FIG. 4*i*passes through the cyan developer housing 48, cyan toner is deposited thereon thereby forming blue image areas (FIG. 4*j*). The DAD undeveloped areas 130 of the photoreceptor are developed with cyan toner as are the DAD yellow image areas 138, FIG. 4*j*.

Following the creation of the cyan, green and blue toner images in the step illustrated in 4*j*, these are voltage leveled to the background voltage level of −400 volts, FIG. 4*k*. Then the photoreceptor is flood exposed with red light using the combination blue/red lamp 52, FIG. 41. This flood exposure step serves to condition the indistinguishable DAD images, 132 and 140 such that they are rendered developable images 142 and 144 to be developed with magenta toner. In the case of the DAD image 142, those images are developed with magenta toner and in the case of the DAD images 144 those images are developed with the magenta toner to form red images.

The specific embodiments of the combination blue/red exposure structure 52 will now be discussed with reference to FIGS. 5 through 8. As shown therein, the lamp structure may consist of a white light source with movable filters or it may comprise two narrow band light sources which are selectively shuttered.

Figure 5A:
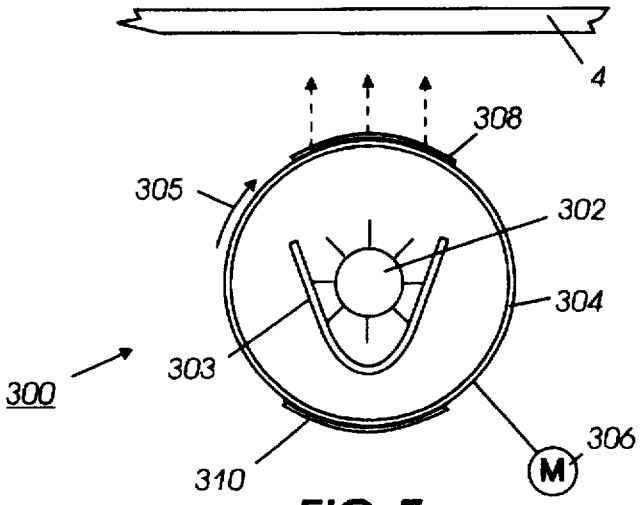
FIGS. 5*a* and 5*b* depict an embodiment of a dual wavelength illumination structure utilized In the two pass xerographic printing system shown in FIG. 1.
Figure 5B:
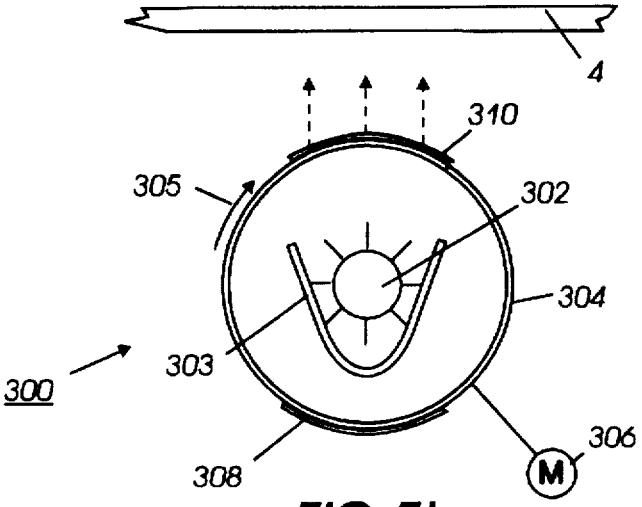

As illustrated in FIGS. 5*a* and 5*b*, an exposure structure 300 comprises a white light source 302 supported internally of a filter support structure 304 which is supported for rotation in the direction of the arrow 305 via a motor 306 and associated drive mechanism (not shown). A reflector 303 is provided for focusing illumination from the white light source 302. The exposure structure 300 further comprises a red bandpass filter 308 and a blue bandpass filter 310 carried by the support structure 304, the former of which transmits red light and the latter of which transmits blue light. In response to the machine program, the motor 306 and its associated drive mechanism serves to position one or the other of the filters between the white light source and the photoreceptor depending upon which pass of the photoreceptor is being effected. As shown in FIG. 5*a*, the red bandpass filter 308 is positioned intermediate the photoreceptor belt 4 and the white source 302 during a first pass of the photoreceptor past the processing stations of the printer. FIG. 5*b* illustrates the blue bandpass filter in its operative position corresponding to the second pass of the printer.

Figure 6:
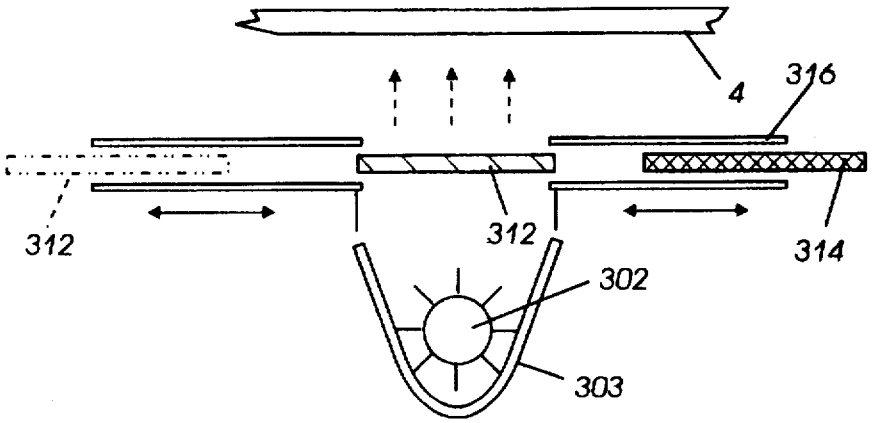
FIG. 6 depicts another embodiment a dual wavelength illumination structure.

As illustrated in FIG. 6, the white light source 302 and reflector 303 are utilized in connection a red bandpass filter structure 312 and a blue bandpass filter 314. The filter structure 312 comprises a rectangular-shaped frame member 314 containing a pair of filters 316 and 318. The filter structures 312 and 314 are slidable in a guide structure 316 for selective positioning of thereof intermediate the white light source 302 and the photoreceptor 4 in accordance with which pass of the photoreceptor is being effected.

Figure 7A:
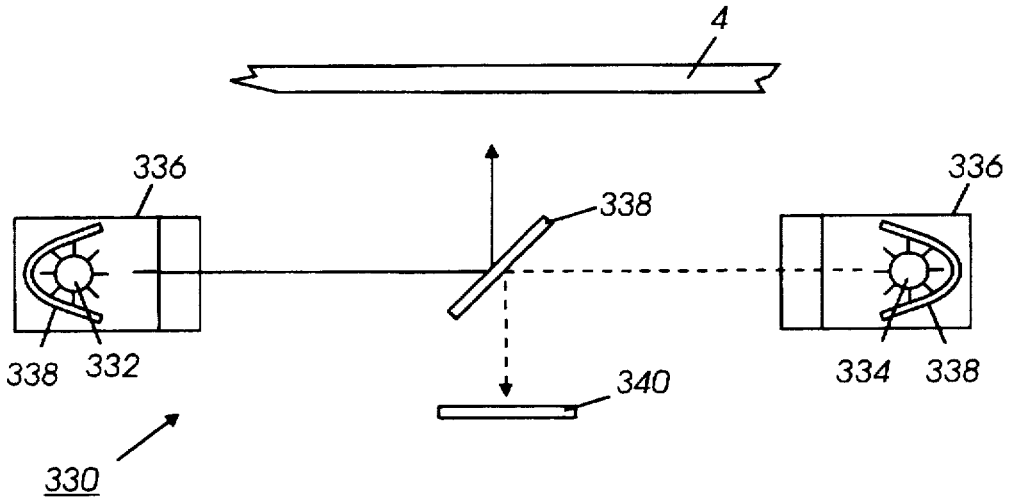
FIGS. 7*a* and 7*b* illustrate yet another embodiment of a dual wavelength illumination structure.
Figure 7B:
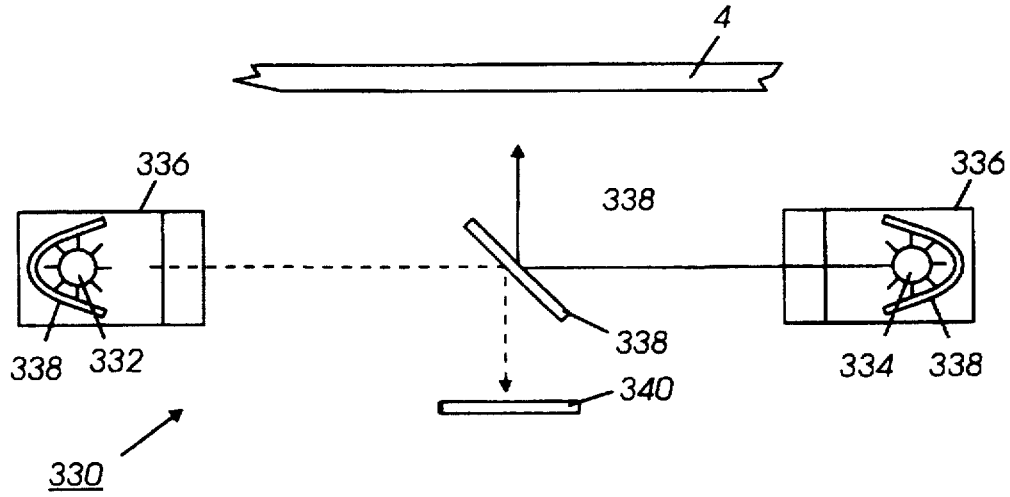

As disclosed in FIGS. 7*a* and 7*b*, an exposure structure 330 comprises two narrow band light sources 332 and 334. The light source 332 by way of example comprises a source of blue light while the light source 334 comprises a source of red light. The light source 332 is disposed within a light baffle 336 together with a reflector 338, the latter of which serves to direct the light from the source 332 toward a double-sided, articulated mirror 338. The mirror is supported for movement from the position shown in FIG. 7*a* where it reflects blue light toward the photoreceptor 4 to the position shown in FIG. 7*b* where it reflects red light that impinges on the photoreceptor. When the blue light is reflected toward the photoreceptor the light from the red light source 334 is also reflected by the mirror but in the opposite direction toward an absorbing cavity 340. When the red light is reflected toward the photoreceptor the light from the blue light source 332 is also reflected by the mirror but in the opposite direction toward on absorbing cavity 340.

It should be noted that the colors of the flood exposures are the complementary colors to the toner colors which are deposited immediately prior to flood exposure. Hence the blue flood exposure follows deposition of yellow toner and the red flood exposure follows deposition of cyan toner. In the first pass we have arbitrarily chosen to deposit yellow toner first followed by magenta toner. The process would work equally well by interchanging the toner colors in the yellow and magenta housings. This would result in development of magenta toner first followed by a flood exposure followed by development of yellow on the first pass. On the second pass cyan toner would be developed first followed by flood exposure followed by development of yellow toner. In this scenario the flood exposure on the first pass would be with green light followed by flood exposure with red light on the second pass. The extensions of the switchable flood lump concept to different color combinations is obvious to those skilled in the art and are also covered within the scope of this invention.

Figure 8:
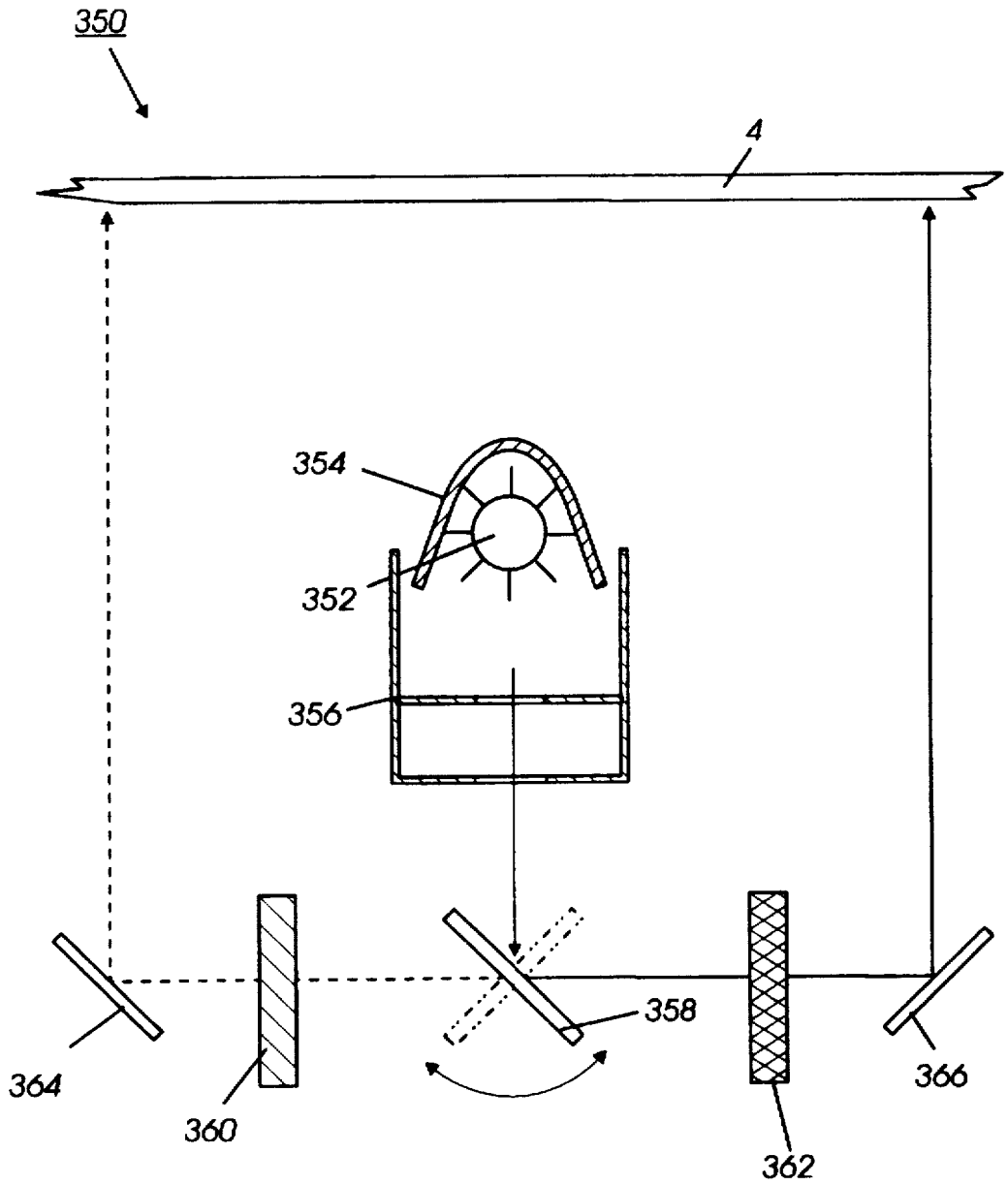
FIG. 8 shows still yet another embodiment of a dual wavelength illumination structure.

As depicted in FIG. 8, an exposure device 350 comprises a broad band light source 352, a reflector 354 and a light baffle 356. Light from the source 352 is directed to an articulated mirror 358. The mirror 358, in turn, reflects the light in either the direction of a blue bandpass filter 360 or a red bandpass filter 362. The blue light passed through the blue bandpass filter 360 is reflected by a stationary mirror 364 in the direction of the photoreceptor 4. The red light passed through the red bandpass filter 362 is reflected by a stationary mirror 366 such that it impinges on the photoreceptor 4.

We claim:

1. Apparatus for creating full color images using IOI development on a charge retentive structure, said apparatus comprising:

a. means for uniformly charging said charge retentive structure to a predetermined voltage level;

b. exposure means for creating tri-level latent electrostatic images comprising developable CAD images at a first voltage level, developable DAD images at a second voltage level, non-developable DAD images and background areas at a third voltage level;

c. means for rendering said CAD and DAD images visible with marking particles to thereby form areas of first and second color images on said charge retentive structure.

d. means for voltage leveling said CAD and DAD images to said background voltage level;

e. means for conditioning said non-developable DAD image to produce another developable DAD image, said conditioning means comprising an exposure device capable of directing light of at least two different wavelengths toward said photoreceptor, said exposure device comprising means operable during a first pass of said photoreceptor past a plurality of process stations for directing one of said two wavelengths of light toward said photoreceptor;

f. means for developing said another developable DAD image;

g. means for flood illuminating said charge retentive structure with white light;

h. means for recharging said charge retentive surface to predetermined voltage level;

i. means for reducing the voltage levels associated with said developed CAD and DAD images and un-developed areas of said charge retentive structure to thereby form immediately developable DAD images and yet another non developable DAD image;

j. means for reducing the remainder of the voltages associated with said developed CAD and DAD images to the voltage level of said background areas;

k. means for rendering visible said immediately developable DAD images formed by reducing the voltage levels associated with said CAD and DAD images and un-developed image areas;

l. means for voltage leveling said DAD images rendered visible in step k;

m. means for conditioning said charge retentive structure for converting said yet another non-developable DAD image to still another developable DAD image, said conditioning means comprising an exposure device capable of directing light of at least two different wavelengths toward said photoreceptor, said exposure device comprising means operable during a second pass of said photoreceptor past a plurality of process stations for directing another of said different wavelengths toward said photoreceptor;

n. means for developing said still another non-developable DAD image;

o. means for pretransfer charging said charge retentive structure; and p. means for transferring said images to a final substrate.

2. Apparatus according to claim 1 wherein said exposure device comprises a source of white light and a pair of filters one of which passes blue light and the other of which passes red light and means for effecting passage of said blue light during said first pass of said photoreceptor and passage of red light during said second pass of said photoreceptor.

3. Apparatus according to claim 2 wherein said exposure device comprises a frame structure including said pair of filters.

4. Apparatus according to claim 3 wherein said frame structure is rectangular.

5. Apparatus according to claim 4 wherein said frame structure comprises a cylindrical member.

6. Apparatus according to claim 1 wherein said exposure device comprises a pair of narrow band light sources and means for directing one of said narrow band light sources toward said photoreceptor during a first pass and another of said narrow band light sources toward said photoreceptor during a second pass.

7. Apparatus according to claim 6 wherein means for directing comprises a mirror.

8. Apparatus according to claim 1 wherein said means for directing comprises means for pivoting said mirror between two operable positions.

9. A method of creating full color images using IOI development on a charge retentive structure, said method including the steps of:

a. uniformly charging said charge retentive structure to a predetermined voltage level;

b. using an exposure device, creating tri-level latent electrostatic images comprising developable CAD images at a first voltage level, developable DAD images at a second voltage level, non-developable DAD images and background areas at a third voltage level;

c. rendering said CAD and DAD images visible with marking particles to thereby form areas of first and second color images on said charge retentive structure.

d. voltage leveling said CAD and DAD images to said background voltage level;

e. conditioning said non-developable DAD image to produce another developable DAD image, said step of conditioning being effected using a single exposure device capable of directing light of at two different wavelengths toward said photoreceptor, said exposure device comprising means operable during a first pass of said photoreceptor past a plurality of process stations for directing one of said two wavelengths of light toward said photoreceptor;

f. developing said another developable DAD image;

g. flood illuminating said charge retentive structure with white light;

h. recharging said charge retentive surface to a predetermined voltage level;

i. reducing the voltage levels associated with said developed CAD and DAD images and un-developed areas of said charge retentive structure to thereby form immediately developable DAD images and yet another non developable DAD image;

j. reducing the remainder of the voltages associated with said developed CAD and DAD images to the voltage level of said background areas;

k. rendering visible said immediately developable DAD images formed by reducing the voltage levels associated with said CAD and DAD images and un-developed image areas;

l. voltage leveling said DAD images rendered visible in step k;

m. conditioning said charge retentive structure for converting said yet another non-developable DAD image to still another developable DAD image, said step of conditioning being effected using said exposure device;

n. developing said still another non-developable DAD image o. pretransfer charging said charge retentive structure; and p. transferring said images to a final substrate.

10. The method according to claim 9 wherein step e is effected using an exposure device comprising a source of white light and a pair of filters one of which passes blue light and the other of which passes red light and means for effecting passage of said blue light during said first pass of said photoreceptor and passage of red light during said second pass of said photoreceptor.

11. The method according to claim 10 wherein said exposure device comprises a frame structure including said pair of filters.

12. The method according to claim 11 wherein said frame structure is rectangular.

13. The method according to claim 12 wherein said frame structure comprises a cylindrical member.

14. The method according to claim 9 wherein said exposure device comprises a pair of narrow band light sources and means for directing one of said narrow band light sources toward said photoreceptor during a first pass and another of said narrow band light sources toward said photoreceptor during a second pass.

15. The method according to claim 14 wherein means for directing comprises a mirror.

16. The method according to claim 15 wherein said means for directing comprises means for pivoting said mirror between two operable positions.

* * * * *